United States Patent [19]

Kenyon

[11] 4,373,563

[45] Feb. 15, 1983

[54] SAWING OF LUMBER FROM LOGS

[76] Inventor: Alan Kenyon, House No. 3, Acme Township, Sabie, Transvaal, South Africa

[21] Appl. No.: 230,041

[22] Filed: Jan. 29, 1981

Related U.S. Application Data

[60] Continuation of Ser. No. 950,313, Oct. 10, 1978, abandoned, which is a division of Ser. No. 599,950, Jul. 28, 1975, Pat. No. 4,127,044.

[30] Foreign Application Priority Data

Jul. 30, 1974 [ZA] South Africa ..... 74/4840

[51] Int. Cl.[3] ..... B27B 1/00

[52] U.S. Cl. ..... 144/357; 144/242 E; 144/246 F; 144/249 A; 83/446; 83/425; 83/367

[58] Field of Search ..... 83/446, 425, 425.2, 83/367; 144/312, 253 C, 253 A, 249 B, 249 A, 242 E, 246 B, 246 G

[56] References Cited

U.S. PATENT DOCUMENTS

| | | | |
|---|---|---|---|
| 259,661 | 6/1882 | Bowker . | |
| 1,263,443 | 4/1918 | Lien . | |
| 2,785,715 | 3/1957 | Brundell et al. . | |
| 3,386,564 | 6/1968 | Pease . | |
| 3,456,774 | 7/1969 | Blickenderfer et al. . | |
| 3,621,972 | 11/1971 | Reuter . | |
| 3,665,984 | 5/1972 | Ackerfeldt . | |
| 3,685,556 | 8/1972 | Van Sickle . | |
| 3,844,398 | 10/1974 | Pinat . | |
| 3,844,399 | 10/1974 | Seller et al. | 144/246 F |
| 3,858,631 | 1/1975 | Andersson et al. | 144/246 F |
| 4,144,782 | 3/1979 | Lindstrom | 83/420 |

FOREIGN PATENT DOCUMENTS

| | | | |
|---|---|---|---|
| 276729 | 12/1969 | Austria . | |
| 266672 | 10/1913 | Fed. Rep. of Germany . | |
| 504700 | 8/1930 | Fed. Rep. of Germany . | |
| 827545 | 1/1952 | Fed. Rep. of Germany . | |
| 6108 | 9/1915 | Finland . | |
| 11753 | 3/1931 | Finland . | |
| 27224 | 2/1955 | Finland . | |
| 3031/69 | 5/1969 | Finland . | |
| 739292 | 10/1932 | France . | |
| 49-7557 | 2/1974 | Japan . | |
| 33098 | 6/1912 | Sweden . | |
| 34951 | 6/1913 | Sweden . | |
| 116462 | 5/1946 | Sweden . | |
| 306415 | 11/1968 | Sweden . | |
| 334460 | 6/1971 | Sweden . | |
| 366679 | 5/1974 | Sweden . | |
| 545 | of 1852 | United Kingdom | 83/420 |
| 414660 | 8/1934 | United Kingdom . | |
| 455161 | 10/1936 | United Kingdom . | |
| 995408 | 6/1965 | United Kingdom . | |

*Primary Examiner*—Donald R. Schran

*Attorney, Agent, or Firm*—Nims, Howes, Collison & Isner

[57] ABSTRACT

The sawing of an elongated workpiece, such as a log or cant, is effected by feeding the workpiece longitudinally through a saw; sensing the longitudinal configuration of a longitudinal side surface of the workpiece on one side only of the workpiece as the latter passes through the saw; and orientating the workpiece relative to the saw in accordance with the sensed configuration to saw the workpiece longitudinally substantially parallel to the sensed configuration. For the sawing of a crooked workpiece, the configuration of a longitudinally extending concave side surface is sensed and the workpiece is sawn "round the curve" substantially parallel to the sensed concave configuration.

8 Claims, 6 Drawing Figures

Fig 6.
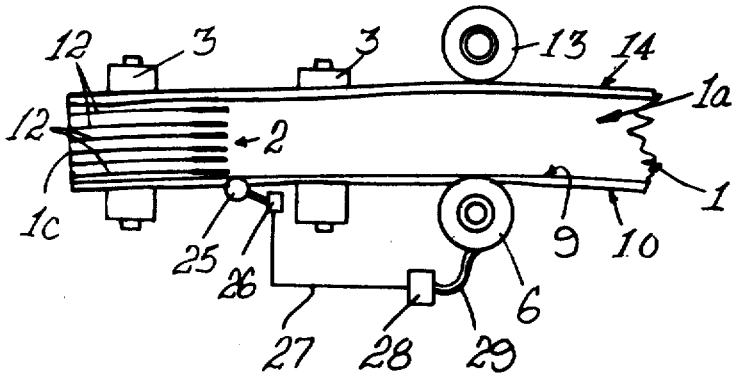
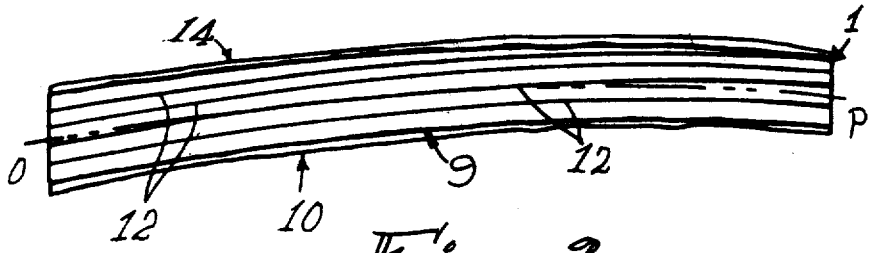
Fig 2.

SAWING OF LUMBER FROM LOGS

This is a Continuation application of U.S. Ser. No. 950,313 filed Oct. 10, 1978, now abandoned, which is a Divisional application of U.S. Ser. No. 599,950 filed July 28, 1975, now U.S. Pat. No. 4,127,044.

FIELD OF INVENTION

This invention relates to methods for the sawing of lumber from logs and cants.

PRIOR ART

It is well known in the timber industry to saw lumber from logs by feeding a log to a first gang frame saw which is variously known as a log frame or a head saw and which comprises a pair of transversely spaced saws for sawing off longitudinal strips along opposite sides of the log to produce a so-called cant with two opposed, longitudinally extending flat faces. Thereafter, with the flat faces disposed horizontally, the cant is fed to a second gang frame saw which is variously known as a deal frame, cant frame or cant saw and which comprises a plurality of transversely spaced saw blades adapted to saw the cant longitudinally into a plurality of boards or planks and other sawn lumber as the cant moves through the deal frame.

The orientation of logs and cants relative to the log frame and the deal frame respectively is often controlled manually by various means and as a guide for the operator, it is common practice to cast shadow lines along the path of travel of the logs and cants ahead of the log frame and the deal frame respectively, the shadow lines being positioned to assist the operator in presenting logs and cants to the log frame and deal frame respectively in such a manner that a sawn lumber yield as close as possible to an optimum yield is obtained.

In order to obtain an optimum yield, it is necessary to obtain from each log the maximum effective volume of sawn lumber having the maximum economic value. Normally, the overall loss in volume sustained in a sawmill for all sizes and shapes of logs sawn is relatively high and can be in the order of up to 50% and more. Losses in volume occur due to factors such as the need to square up round logs, wastage in the form of saw dust in the zone of the saw cuts, shrinkage of sawn boards on drying and crooked logs. It is not sufficient merely to achieve the best possible volume recovery, as it is also important to produce sawn lumber of high quality having a maximum economic value.

With conventional manual control of cant orientation, it seldom happens in practice that a crooked cant is presented to the deal frame in an ideal manner to obtain a recovery yield approaching the optimum. All too often a crooked cant is sawn in such a manner that uneconomical lengths and/or widths of board are obtained.

Apparatus for automatically controlling the sawing of logs and cants substantially parallel to a straight line through the centres of the end surfaces of a log or cant is known, for example from U.S. Pat. No. 3,665,984. Such straight line sawing suffers from the disadvantages that considerable cross-grained timber and short lengths are obtained, particularly in the case of crooked logs and cants.

Centring apparatus for curve sawing along or parallel to the longitudinal centre line of a curved or crooked log is also known, for example from German patent specification No. 504 700 and Swedish patent specification nos. 334 460 and 366 679.

In the arrangement of German patent specification no. 504 700 and Swedish patent specification no. 334 460 a pair of centring rails or rolls are pivotally mounted on opposite sides of a log to be sawn for movement towards and away from each other transversely to the log, the rails or rolls being biassed inwardly towards each other by a common weight so that normally they exert equal pressures on the log on opposite sides thereof to centre the log for sawing along or parallel to the longitudinal centre line of the log. In the event of one of the pair of rails or rolls being urged outwardly against the action of the biassing weight by the outer surface of the log, such rail or roll increases its pressure on the log while the other rail or roll decreases its pressure on the log so that there is a tendency to orientate the log to equalise the forces exerted on opposite sides of the log by the rails or rolls.

Swedish patent specification no. 366 679 discloses a device comprising a pair of swingably mounted centring rollers arranged to contact a timber block or the like on opposite sides thereof and to exert inward pressure in opposite directions on the block under the action of common spring means, the two centring rollers being coupled together so that they can move in unison outwardly away from each other and inwardly towards each other from a normal starting position. The arrangement is such that if any one of the centring rollers is displaced outwardly by a bulge or outward curve on the surface of the timber block the other arm is also swung outwardly, the rollers acting on the block to centre it so that its centre lies on the middle line of the centring device. If on the other hand, any one of the centring rollers is allowed to move inwardly due to an inward bend in the block, the other roller is also caused to swing inwardly so that centring of the block is again achieved.

Although an improved recovery yield can be obtained by sawing along or parallel to the longitudinal centre line of a crooked cant, it still falls short of the optimum.

SUMMARY OF THE INVENTION

It is accordingly an object of the present invention further to improve the production of lumber from crooked cants.

According to the invention a method of sawing an elongated workpiece includes the steps of feeding the workpiece longitudinally through a saw; sensing the longitudinal configuration of a longitudinal side surface of the workpiece on one side only of the workpiece as the latter passes through the saw; and orientating the workpiece relative to the saw in accordance with the sensed configuration to saw the workpiece longitudinally substantially parallel to the sensed configuration.

For the purposes of this specification, the term "elongated workpiece" includes a log and a cant.

Preferably, the workpiece is orientated by exerting lateral orientating pressure thereon, the orientating pressure being exerted only on the side of the workpiece on which the longitudinal side surface is located.

Control pressure may be exerted on the workpiece on the side opposite to that on which the orientating pressure is exerted, the control pressure being substantially less than the orientating pressure.

The method of the invention is applicable to substantially straight workpieces but has particular application to the sawing of crooked workpieces.

Thus, in a preferred embodiment of the invention, a crooked workpiece is fed longitudinally through the saw; the configuration of a longitudinally extending concave side surface of the workpiece is sensed; and lateral orientating influence is exerted on the workpiece in accordance with the sensed configuration to orientate the workpiece relative to the saw to saw the workpiece longitudinally substantially parallel to the sensed concave configuration.

For the purposes of this specification, the term "crooked workpiece" includes a curved or bent workpiece.

Preferably, lateral orientating influence is exerted on the workpiece by applying lateral orientating pressure on the workpiece on the concave side surface only.

The lateral orientating pressure is preferably exerted on the concave side surface of the workpiece at or near the longitudinally extending concave edge of a flat face of the workpiece.

Lateral orientating pressure may be exerted on the concave side surface of the workpiece in spaced positions located at or near longitudinally extending concave edges of a pair of opposed flat faces on the workpiece.

The spaced positions in which lateral orientating pressure is exerted on the concave side surface of the workpiece may also be spaced longitudinally along the workpiece.

The configuration of the concave side surface may be sensed in the zone of the or each position in which orientating pressure is exerted on the workpiece.

Control pressure may be exerted on the convex side surface of the workpiece, the control pressure being substantially less than the orientating pressure exerted on the concave side surface.

According to another aspect of the invention the method is carried out by apparatus for controlling the sawing of an elongated workpiece includes means operative to sense the longitudinal configuration of a longitudinal side surface of the workpiece on one side only of the workpiece as the latter passes through a saw and to orientate the workpiece relative to the saw in accordance with the sensed configuration for sawing the workpiece longitudinally substantially parallel to the sensed configuration.

In one embodiment of the apparatus, separate sensing and orientating means are provided, the orientating means being arranged to operate under the influence of the sensing means.

Any suitable mechanical, electrical, optical or photoelectrical sensing means may be provided to sense the longitudinal configuration of the longitudinal side surface of the workpiece.

The orientating means may comprise at least one pressure element, such as a roller, adapted to exert lateral orientating pressure on the workpiece on one side only thereof, or may comprise feed means operative to adjust the lateral position of the workpiece relative to the saws.

Preferably, the sensing means is adapted to engage a longitudinally extending concave side surface of a crooked workpiece or a longitudinally extending concave edge of a flat face on a crooked workpiece; and the orientating means comprises at least one pressure element operative to exert lateral orientating pressure on the workpiece on the concave side only of the workpiece.

In a preferred embodiment of the apparatus, combined sensing and orientating means is provided. Such combined sensing and orientating means may comprise at least one orientating pressure element locatable ahead of the saw on one side only of the workpiece in contact with a longitudinally extending side surface of the workpiece as it passes through the saw, the pressure element being operative to exert lateral orientating pressure on the one side only of the workpiece in accordance with the configuration of the longitudinal side surface of the workpiece moving past the pressure element.

The orientating pressure element is preferably arranged to contact the longitudinal side surface of the workpiece at or near the longitudinally extending edge of a flat face on the workpiece.

The orientating pressure element may be resiliently movable laterally relative to the workpiece to accommodate lateral irregularities in the longitudinally extending side surface of the workpiece. Means may be provided for resiliently urging the orientating pressure element laterally relative to the workpiece to exert orientating pressure on the workpiece.

The orientating pressure element may be movable between operative and inoperative positions. Thus, the orientating pressure element may be mounted on a pivotally mounted support.

Ram means may be provided for moving the orientating pressure element between its operative and inoperative positions and also for resiliently urging the orientating pressure element into engagement with the workpiece.

Preferably, at least two spaced orientating pressure elements are provided, such orientating pressure elements being resiliently movable relative to each other in a direction laterally to the workpiece and arranged to engage the workpiece on the same side thereof.

The orientating pressure elements may be spaced apart transversely to and/or longitudinally along the workpiece.

The spaced orientating pressure elements are preferably arranged to engage the longitudinal side surface of the workpiece at or near longitudinally extending edges of a pair of opposed flat faces on the workpiece.

Apart from being resiliently movable relative to each other, the orientating pressure elements may also be resiliently movable together laterally relative to the workpiece. Thus, the orientating pressure elements may be mounted in spaced relationship on a common carrier which is resiliently rotatable about an axis disposed transversely to the workpiece and which is resiliently movable relative to the workpiece in a lateral direction.

The common carrier may be fast with a torsion member operative to twist about the rotational axis of the carrier when the orientating pressure elements are displaced relative to each other in a direction laterally to the workpiece by protruberances or the like on the side surface of the workpiece.

The orientating pressure rollers may be movable together between operative and inoperative positions.

The orientating pressure elements may be mounted on a common pivotally mounted support. Where the orientating pressure rollers are mounted on a common carrier fast with a torsion member, the latter may be mounted on the common support.

The apparatus may also include at least one control pressure element locatable ahead of the saw in engagement with a longitudinally extending side surface of the workpiece on the side opposite to the orientating pressure element or elements, the control pressure element being operative to exert lateral control pressure on the opposite side of the workpiece which is substantially less than the orientating pressure exerted on the workpiece.

For the sawing of a crooked workpiece, the orientating pressure element or elements are preferably arranged to engage a longitudinal concave side surface of the workpiece with the control pressure roller engaging an opposed longitudinal convex side surface.

BRIEF DESCRIPTION OF THE DRAWING

For a clear understanding of the invention preferred embodiments will now be described purely by way of example with reference to the accompanying drawings in which:

FIG. 2 is a diagrammatic plan view of a curved cant illustrating "round the curve" saw cuts parallel to the longitudinal concave side surface of the cant obtained with the apparatus of FIG. 1.

FIG. 6 is a diagrammatic plan view of another form of orientation control according to the invention incorporating separate sensing means and orientating means.

In the drawings, like parts are indicated by like reference numerals.

DETAILED DESCRIPTION

Figure 1:
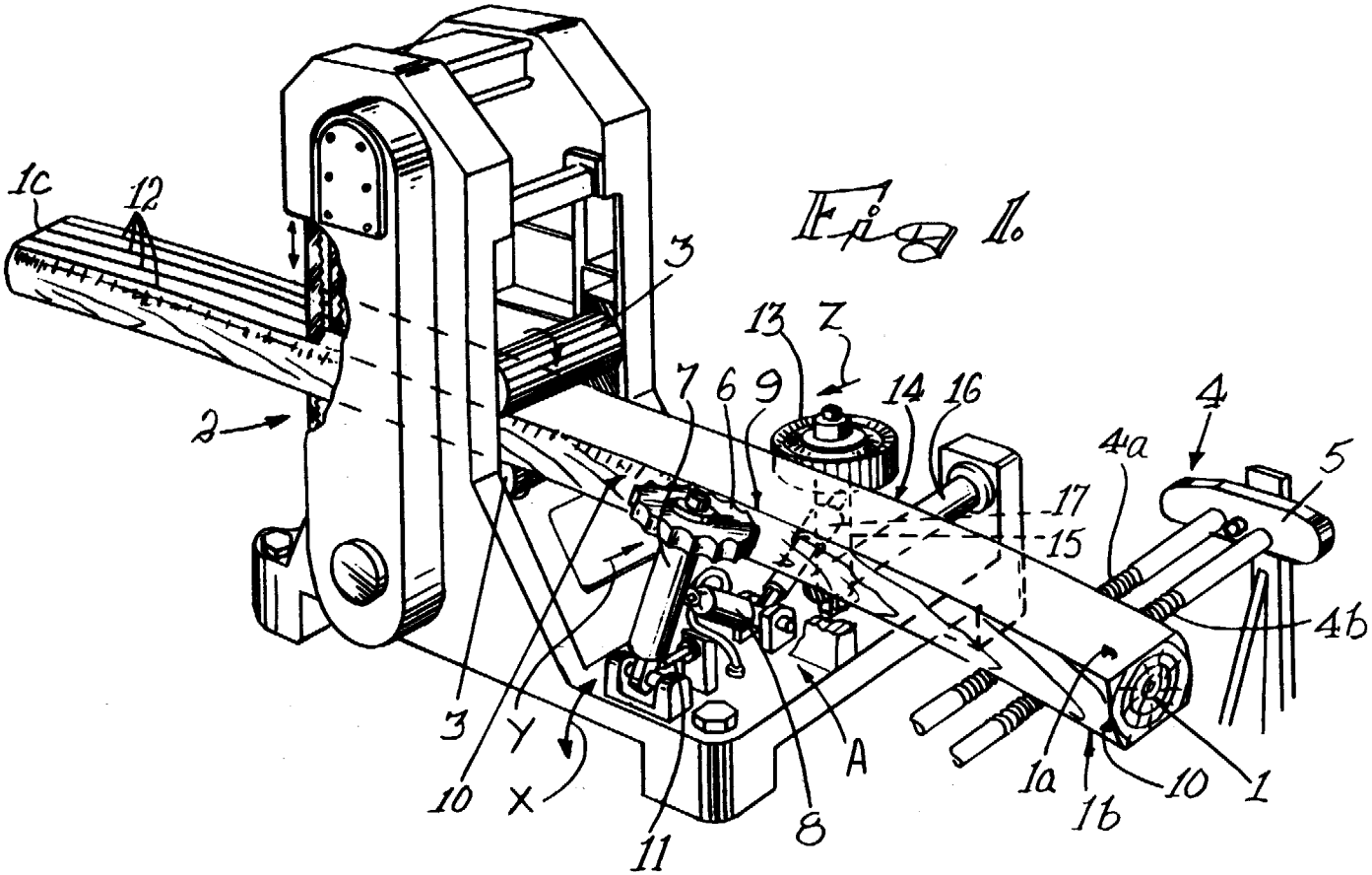
FIG. 1 is a diagrammatic perspective view of lumber sawing apparatus incorporating orientation control means according to the invention which comprises a single sensing and orientating roller.

Referring first to FIG. 1, a curved cant 1 with its pair of opposed flat faces 1*a*, 1*b* disposed horizontally, is fed longitudinally through a reciprocatory deal frame 2 which includes a plurality of transversely spaced reciprocatory saws, by means of at least one pair of feed rollers 3 which are rotatably driven and by a set of spaced spiral rollers 4. A plurality of support rollers 16 (of which only one is shown) is provided in spaced relationship along the path of travel of cant 1.

The two spiral rollers 4*a*, 4*b* of the set of rollers 4 are rotatably mounted at opposite ends on a pivotally mounted carrier 5 and have spiral flights of opposite hand. The carriers 5 of the spiral rollers 4 are pivotable about a horizontal axis by an operator so that either the one or the other spiral roller 4*a* or 4*b* is located above the other and in operative contact with the lower flat face 1*b* of cant 1. Depending on whether the spiral roller 4*a* or 4*b* which is in operative contact with cant 1, has a left hand or right hand spiral flight, the cant 1 can be steered left or right in a horizontal direction as it approaches deal frame 2.

A shadow line (not shown) may be provided to assist the operator in guiding the cant 1 in conventional manner toward deal frame 2.

So far the apparatus is conventional.

According to the invention, automatic cant orientating means A is provided just ahead of deal frame 2.

Orientating means A comprises orientating pressure roller 6 which is rotatably mounted on the upper end of support 7 which is pivotally mounted at its lower end to permit pressure roller 6 to be moved between operative and inoperative positions in the direction of arrows X by means of hydraulic ram 8.

Orientating pressure roller 6 may be located in its inoperative position during the initial approach run of cant 1 towards deal frame 2 until the leading end 1*c* of cant 1 passes between feed rollers 3. During the initial approach run, the operator would steer cant 1 by means of spiral rollers 4*a*, 4*b* to locate the longitudinally extending concave edge 9 of the upper flat face 1*a* of cant 1 as close as possible to the shadow line.

As the leading end 1*c* of cant 1 passes between the feed rollers 3, the operator actuates ram 8 to move orientating pressure roller 6 towards its operative position to contact the longitudinally extending concave side surface 10 of cant 1 at or near the longitudinally extending concave edge 9 of the upper flat face 1*a*. Because cant 1 is curved and orientating pressure roller 6 contacts longitudinally extending concave side surface 10 of cant 1, the trailing portion of cant 1 curves laterally in the direction of orientating pressure roller 6 so that as cant 1 passes through deal frame 2, the longitudinally extending concave side surface 10 of cant 1 tends to bear laterally outwardly against orientating roller 6 in a direction opposite to that of arrow "y".

Ram 8 resiliently urges pressure roller 6 to exert inward lateral orientating pressure on cant 1 in the direction of arrow Y. Inward movement of pressure roller 6 is restricted by adjustable stop 11 which is set according to the required saw line so that cant 1 is suitably positoned laterally relative to the saws of deal frame 2 by pressure roller 6 in accordance with the configuration of the longitudinally extending zone of concave side surface 10 of cant 1 moving past pressure roller 6. Cant 1 is caused to be sawn along longitudinal zones 12 lying substantially parallel to the longitudinally extending zone of concave side surface 10 of cant 1 which is contacted by pressure roller 6 and also lying along and substantially parallel to longitudinally extending concave edge 9 of the upper flat face 1*a* of cant 1. Cant 1 is in effect "sawn round the curve" as shown in FIG. 2.

It will be appareciated that as cant 1 passes through deal frame 2, orientation pressure roller 6 senses the longitudinal configuration of the longitudinal zone of concave side surface 10 of cant 1 which moves past roller 6 and causes orientation of cant 1 so that it is sawn substantially parallel to the sensed configuration. In effect, orientating pressure roller 6 acts as a combined configuration sensing and cant orientating means, the configuration being sensed in the same zone in which orientating pressure is exerted on cant 1. Since roller 6 contacts concave side surface 10 adjacent to concave edge 9 of upper flat face 1*a*, roller 6 also senses the configuration of concave edge 9.

It will be appreciated that stop 11 determines the extreme inward position of roller 6 and therefore the spacing between the periphery of roller 6 and the saws of deal frame 2. The stop 11 therefore determines the spacing of the saw lines 12 from the sensed configuration of concave side surface 10 and/or edge 9 of cant 1.

Ram 8 permits roller 6 resiliently to accommodate lateral irregularities in the longitudinally extending concave side surface 10 of cant 1.

The position of roller 6 is preferably adjustable axially along support 7 and transversely to cant 1 to accommodate cants of different diameter ranges. Stop 11 may also be adjusted to suit cants of different diameter ranges.

Under certain circumstances, it may be sufficient to use only orientating pressure roller 6, particularly where relatively thick and heavy cants in excess of about 29 cms. in diameter are passed through deal frame 2 at relatively low speed. However, a cant may tend to drift or move away from orientating pressure roller 6. When smaller cants below about 29 cms. in diameter are fed to the saws at relatively high speed, it may be necessary to include control pressure roller 13 adapted to engage the longitudinally extending convex side surface 14 of cant 1 and resiliently to exert inward lateral pressure on cant 1 in the direction of arrow Z thereby to control the entry of cants into deal frame 2 and to minimize the tendency of cants to drift or move away from the orientating pressure roller 6, the control pressure exerted by control pressure roller 13 on cant 1 being substantially less than the pressure exerted by orientating pressure roller 6.

The control pressure roller 13 eliminates the need for continually moving orientating roller 6 between its operative and inoperative positions for the initial approach run of each successive cant towards deal frame 2. Control pressure roller 13 assists orientating pressure roller 6 automatically to present cant 1 to deal frame 2 in a correct manner and position. Control pressure roller 13 also facilitates the speedy throughput normally required for smaller diameter cants.

In similar manner to orientating pressure roller 6, control pressure roller 13 is rotatably mounted in axially adjustable manner on the upper end of support 15 which is pivotably mounted at its lower end to permit roller 13 to be moved between operative and inoperative positions by ram 17 which is also operative resiliently to urge roller 13 to exert pressure on cant 1. Adjustable stop means (not shown) similar to 11 is also provided for control pressure roller 13 and is set to suit the particular diameter of cant 1.

In one particular practical embodiment of the invention, sensing and orientating pressure roller 6 is adapted resiliently to exert lateral pressure on the longitudinally extending concave side surface of a cant and to be pushed back away from the cant by a reaction force in the range from 200–1500 lbsf. (about 890–6675 Newtons), depending on log diameters. Control pressure roller 13 is adapted resiliently to exert lateral pressure on the longitudinal extending convex side surface of the cant and to be pushed back away from the cant by a reaction force in the range from 50–300 lbsf. (about 222.5–1335 Newtons), depending on log diameters.

As shown in FIG. 2, the curved cant 1 is "sawn round the curve" parallel to the concave side surface 10 so that the saw cuts 12 lie at an angle to the longitudinal centre line OP of cant 1. It will be seen that a full length board is obtained on the concave side of cant 1 and that it is only on the convex side 14 that short lengths are obtained. If, on the other hand, a curved cant is sawn parallel to its longitudinal centre line in accordance with the prior art, short lengths are obtained both on the convex and concave sides. An improved yield can thus be obtained by sawing according to the present invention. Improved yield can also be obtained with substantially straight cants if they are sawn parallel to one longitudinal side surface in accordance with the present invention. If a substantially straight cant is sawn parallel to its longitudinal center line in accordance with the prior art, short lengths of timber are normally obtained on opposite sides thereof due to the taper of the cant. With the arrangement of the present invention, a tapered cant is sawn parallel to the one side thereof and a full length board can be obtained on that side. It is only on the other side that short lengths are obtained.

It has been found that if a single sensing and orientating element, such as roller 6 in FIG. 1, is provided to contact a side surface of a cant to be sawn, a satisfactory recovery yield can be obtained but that such a single element is sensitive to:

(a) lateral protruberances or irregularities on the side surface of the cant; and/or (b) variations in the cross-sectional convexity of a cant where the single sensing element contacts the side surface substantially centrally; and/or (c) variations in the widths of a pair of opposed flat faces on the cant where the single sensing element contacts the side surface at or near either flat face. In the latter case, alignment with one corner along an edge of one of the flat faces may give too much wane on the corner along an edge of the other flat face.

Figure 3:
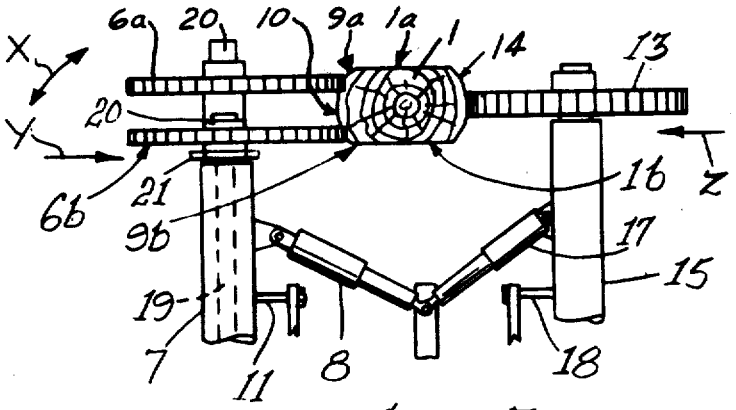
FIG. 3 is a diagrammatic front elevational view of another form of orientation control means according to the invention which comprises two spaced, relatively movable sensing and orientating rollers.
Figure 4:
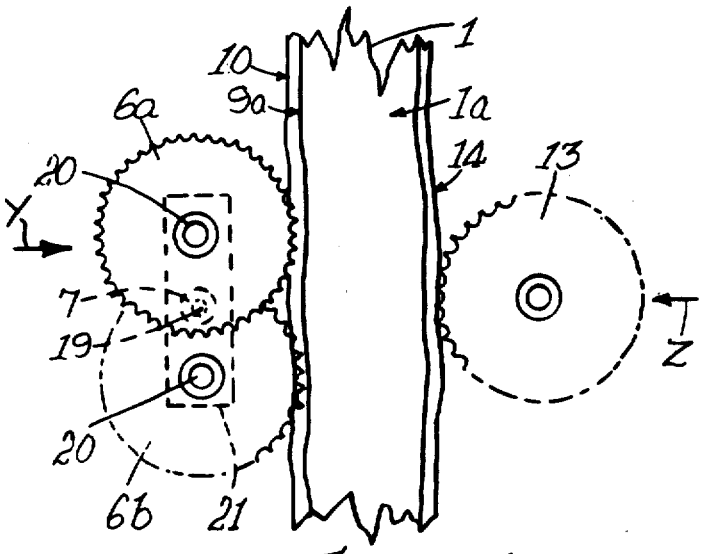
FIG. 4 is a diagrammatic plan view of the orientation control means of FIG. 3.
Figure 5:
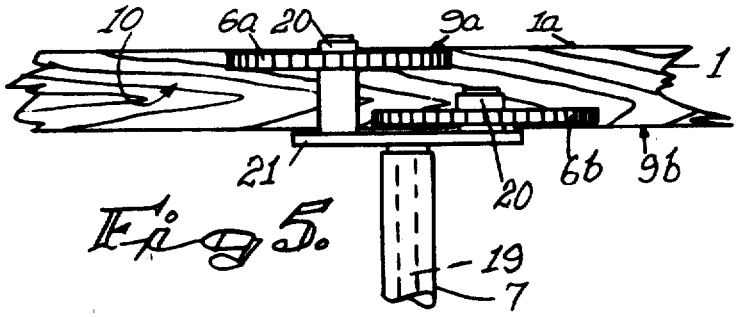
FIG. 5 is a diagrammatic side elevational view of the orientation control means of FIGS. 3 and 4.

This may be avoided or minimised by the arrangement of FIGS. 3 to 5 in which two orientating pressure rollers **6*a*, 6*b* which are adapted to contact the longitudinally extending concave side surface 10 of curved cant 1, are each rotatably mounted on its own spindle 20 which, in turn, are fast with a common carrier 21 mounted on the upper end of a torsion bar 19 which is located in support 7. Support 7 is pivotally mounted at its lower end (not shown) to permit pressure rollers 6*a*, 6*b* to be moved together between operative and inoperative positions in the direction of arrows X (FIG. 1) by means of a pneumatic ram 8**.

Pressure rollers **6*a*, 6*b* are spaced apart longitudinally along cant 1 in a horizontal direction and also transversely to cant 1 in a vertical direction so that in their operative positions shown in the drawings they contact the longitudinally extending concave side surface 10 of cant 1 at or near the upper and lower longitudinally extending concave edges 9*a* and 9*b* respectively of the upper and lower flat faces 1*a* and 1*b*** of the cant.

In operation, pneumatic ram 8 urges pressure rollers **6*a*, 6*b* to exert inward lateral pressure on cant 1 in the direction of arrow Y. Pressure rollers 6*a*, 6*b* continuously act on cant 1 to present it to a deal frame (not shown) in a manner depending on the configuration of the longitudinally extending zones of concave surface 10 of cant 1 moving past pressure rollers 6*a*, 6*b* thereby causing cant 1 to be sawn along longitudinal zones lying substantially parallel to the sensed configuration which is the average position of the two longitudinally extending concave edges 9*a*, 9*b* of the upper and lower flat faces 1*a*, 1*b* of cant 1**.

Ram 8 permits rollers **6*a*, 6to move together laterally relative to cant 1 to accommodate lateral irregularities ion the longitudinally extending concave side surface 10 of cant 1. In addition, torsion bar 7 can twist about its longitudinal axis to permit carrier 21 to rotate about the same axis and allow pressure rollers 6*a*, 6*b* resiliently to move relative to each other in a direction laterally to the cant 1 so that pressure rollers 6*a*, 6*b* are capable of individually accommodating lateral irregularities in the longitudinally extending concave side surface 10 of cant 1. With this arrangement, the effect of irregularities on the orientating influence exerted by pressure rollers 6*a***, 6b on cant 1 is evened or averaged out between the two pressure rollers 6a, 6b. The orientating influence exerted on cant 1 is less sensitive to localised irregularities in concave side surface 10 than would be the case if only one orientating pressure roller is used. More evenly sawn lumber can be obtained.

Preferably, particularly with smaller diameter cants, a control pressure roller 13 may be provided to engage the longitudinally extending convex side surface 14 of cant 1 and resiliently to exert inward lateral pressure on cant 1 in the direction of arrow Z. Ram 17 which is operable on support 15 of control roller 13 may be provided resiliently to urge roller 13 to exert pressure on cant 1. The pressure exerted by control roller 13 on cant 1 is considerably less than the orientating pressure exerted by pressure rollers 6a, 6b on cant 1.

Inward movement of pressure rollers 6a and 6b is restricted by adjustable stop 11 and similarly there is an adjustable stop 18 for control roller 13. Adjustable stop 11 is set according to the required saw line and adjustable stop 18 is set according to the diameter of the cants. Slight adjustment, within limits, of stop 11 may be provided to permit adjustment of the setting of stop 11 for different cants to allow for differing degrees of curve in the cant. This is necessary to compensate for the small errors arising from the spacing between the sensing means and the saw blades.

It will be appreciated that many variations in detail are possible without departing from the scope of the appended claims. For example, any suitable pressure elements other than pressure rollers 6, 13 may be provided.

Other types of cutting saws may be provided instead of a reciprocatory deal frame such as 2 in FIG. 1 and any suitable cant feeding and/or steering means other than feed rollers 3 and spiral rollers 4 may be used.

Instead of separate rams 8 and 17 being provided for orientating roller 6 and control roller 13, a common ram may be connected at opposite ends to supports 7 and 15 of different lengths in suitable positions along their lengths so that orientating roller 6 is urged inwardly with substantially greater force than control roller 13.

Instead of providing combined sensing and orientating means as described above, separate sensing and operating means may be provided as shown diagrammatically in FIG. 6. In this arrangement, a sensing roller 25 is arranged to contact the concave side surface 10 of curved cant 1 in a posiiton at the concave edge 9 of upper flat face 1a on cant 1, so that roller 25 senses the longitudinal configuration of concave side surface 10 in a zone extending along concave edge 9 as cant 1 passes through deal frame 2. Sensing roller 25 is pivotally or otherwise movably mounted on micro-switch or other electrical means 26, displacement of sensing roller 25 in accordance with the sensed configuration being translated into electrical signals. Such electrical signals are utilized via conductor 27 to control the operation of fluid regulator 28, thereby to control the fluid pressure applied via conduit 29 to a ram (not shown) actuating orientating pressure roller 6 so that the lateral orientating pressure applied to cant 1 by orientating roller 6 is variable in accordance with the electrical signals derived from sensing roller 25, which in turn depends on the longitudinal configuration of concave side surface 10 at edge 9.

A pair of vertically spaced sensing rollers 25 may be provided adjacent the concave edges of a pair of opposed flat faces on cant 1.

A control roller 13 may be provided on the convex side of cant 1.

Instead of the lateral orientation of cant 1 being controlled by orientating roller 6, the electrical signals derived from sensing roller 25 may be utilised to control the operation of spiral feed rollers, such as 4 in FIG. 1, thereby to vary the lateral orientating influence exerted on cant 1 by the spiral rollers in accordance with the sensed configuration.

By using an elongated sensing roller disposed at an angle to the horizontal and the vertical so that it contacts only the corner at edge 9 of flat face 1a, the configuration of the corner at concave edge 9 can be scanned and cant 1 orientated laterally in accordance with such configuration.

It will be appreciated that normally the shape and configuration of the outer periphery of a log or cant is not uniform, but varies round its circumference and along its length. It is therefore very difficult, if at all possible, precisely to determine the longitudinal configuration of a side surface of a log or cant and from a practical point of view it is sufficient for the purpose of this invention to sense the general longitudinal configuration of a side surface of a log or cant and to saw generally parallel to the sensed configuration. In the case of a cant with a pair of opposed flat faces, the configuration of a side surface may be sensed in a single longitudinal zone or in a plurality of circumferentially spaced zones located in any suitable position on and/or between corresponding edges of the flat faces. It will be appreciated that the longitudinal configurations of the edges of the flat faces depend at least in part on the longitudinal configuration of the side surface of the cant and are therefore indicative of the general longitudinal configuration of the side surface.

It has been found that with the present invention a board yield as close as practically possible to an optimum yield can be attained. Tests have shown that improvements of up to 10% in recovery can be achieved with the present invention as compared with conventional straight line sawing, depending on the curvature in the logs being sawn. An average improvement of up to 5% can be reasonably attained from a normal log intake.

When sawing curved logs, cross grained timber is largely eliminated as sawing by the method of this invention results in sawing substantially along the grain of the timber. The resulting board, planks and scantlings are of necessity "bowed" after sawing but normal drying methods both natural and artificial, straighten the timber and after drying there is not indication that the timber was bowed before drying.

Preliminary tests have shown a reduction in the amount of lumber which is normally rejected due to twist.

I claim:

1. A method of sawing boards, planks or other sawn lumber from an elongated timber log or cant, comprising the steps of feeding the log or cant, longitudinally through a saw; sensing the longitudinal configuration of an unsawn longitudinally extending side surface of the log or cant on one side only of the log or cant as the latter passes through the saw; orientating the log or cant relative to the saw in accordance with the sensed configuration by exerting only resilient lateral orientating pressure on the log or cant, only on the unsawn side thereof on which the longitudinal configuration is sensed to saw the log or cant longitudinally along at least one saw line substantially parallel to the sensed configuration and restricting the laterally inward extent of the action of the resilient orientating pressure on the log or cant according to the required spacing of the saw line from the sensed configuration.

2. A method of sawing boards, planks or other sawn lumber from an elongated timber log or cant, comprising the steps of feeding the log or cant longitudinally through a saw; sensing the longitudinal configuration of an unsawn longitudinally extending side surface of the log or cant on one side only of the log or cant as the latter passes through the saw; orientating the log or cant relative to the saw in accordance with the sensed configuration by exerting only resilient lateral orientating pressure on the log or cant, only on the side thereof on which the longitudinal configuration is sensed to saw the log or cant longitudinally along at least one saw line substantially parallel to the sensed configuration; restricting the laterally inward extent of the action of the resilient orientating pressure on the log or cant according to the required spacing of the saw line from the sensed configuration; and exerting lateral control influence on the log or cant in a direction generally opposite to that in which the orientating pressure is exerted, the pressure of the control influence on the log or cant being less than the orientating pressure exerted on the log or cant.

3. A method of sawing boards, planks or other sawn lumber from an elongated timber log or cant, including the steps of feeding the log or cant longitudinally through a saw; sensing the longitudinal configuration of an unsawn longitudinally extending side surface of the log or cant in a plurality of longitudinally extending zones spaced transversely around the circumference of the log or cant and located on one side only of the log or cant, as the latter passes through the saw; exerting only resilient lateral orientating pressure on the log or cant in accordance with the sensed configuration only on the unsawn side on which the longitudinal configuration is sensed to saw the log or cant longitudinally along at least one saw line substantially parallel to the mean position of the sensed zones of the unsawn side surface, and exerting lateral control influence on the log or cant in a direction generally opposite to that in which the orientating pressure is exerted, the pressure of the control influence on the log or cant being less than the orientating pressure exerted on the log or cant.

4. A method as claimed in claim 2, wherein lateral control influence is exerted on the log or cant by resiliently applying lateral control pressure on the log or cant on the side opposite to that on which the orientating pressure is exerted, the control pressure being less than the orientating pressure.

5. A method of sawing boards, planks or other sawn lumber from a crooked elongated timber log or cant, comprising the steps of feeding the crooked log or cant longitudinally through a saw; sensing the longitudinal configuration of a plurality of longitudinally extending, circumferentially spaced zones of an unsawn longitudinally extending concave side surface of the log or cant as the latter passes through the saw; applying only resilient lateral orientating pressure on the log or cant on the concave side surface only along the sensed zones in accordance with the sensed configuration to orientate the log or cant relative to the saw; sawing the log or cant longitudinally along at least one saw line substantially parallel to the mean position of the sensed zones of the unsawn concave side surface; and restricting the lateral inward extent of the action of the resilient orientating pressure on the log or cant according to a required spacing of the saw line from the mean position of the sensed zones of the unsawn concave side surface.

6. A method as claimed in claim 5, including the step of resiliently exerting control pressure on the longitudinally extending convex side surface of the log or cant, the control pressure being substantially less than the total orientating pressure.

7. A method of sawing boards, planks or other sawn lumber from an elongated timber log or cant, including the steps of feeding the log or cant longitudinally through a saw; sensing the longitudinally configuration of an unsawn longitudinally extending side surface of the log or cant in a plurality of longitudinally extending zones spaced transversely around the circumference of the log or cant and located on one side only of the log or cant, as the latter passes through the saw; exerting only resilient lateral orientating pressure on the log or cant in accordance with the sense configuration only on the unsawn side on which the longitudinal configuration is sensed to saw the log or cant longitudinally along at least one saw line substantially parallel to the mean position of the sensed zones of the unsawn side surface and resiliently applying lateral control pressure on the log or cant on the side opposite to that on which the orientating pressure is exerted, the control pressure being less than the orientating pressure.

8. Method of sawing boards, planks or other sawn lumber from an elongated timber log or cant, comprising the steps of feeding the log or cant longitudinally through a saw; sensing the longitudinal configurations of a plurality of longitudinally extending, circumferentially spaced zones of an unsawn longitudinally extending side surface of the log or cant which are located on one side only of the log or cant, as the latter passes through the saw; applying resilient lateral orientating pressure on the log or cant along the sensed zones in accordance with the sensed configurations as the log or cant passes through the saw to orientate the log or cant relative to the saw, the orientating pressure being applied only on the unsawn side of the log or cant on which the longitudinal configuration is sensed; sawing the log or cant longitudinally along at least one saw line substantially parallel to the mean position of the sensed zones of the unsawn side surface, and restricting the laterally inward extent of the action of the resilient orientating pressure on the log or cant according to a required spacing of the saw line from the mean position of the sensed zones of the unsawn side surface.

* * * * *